US008248332B2

(12) United States Patent
Kawasaki et al.

(10) Patent No.: US 8,248,332 B2
(45) Date of Patent: Aug. 21, 2012

(54) ACTIVE MATRIX DISPLAY APPARATUS HAVING A CHANGE IN LIGHTING POWER SOURCE BEFORE THE END OF A WRITING PERIOD AND DRIVING METHOD THEREOF

(75) Inventors: Somei Kawasaki, Saitama (JP); Fujio Kawano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 784 days.

(21) Appl. No.: 12/182,582

(22) Filed: Jul. 30, 2008

(65) Prior Publication Data

US 2009/0033599 A1 Feb. 5, 2009

(30) Foreign Application Priority Data

Aug. 3, 2007 (JP) ..... 2007-202991

(51) Int. Cl.
*G09G 3/30* (2006.01)

(52) U.S. Cl. ..... 345/77; 345/82

(58) Field of Classification Search ..... 345/76, 345/82–83, 77

See application file for complete search history.

(56) References Cited

U.S. PATENT DOCUMENTS

| | | | | |
|---|---|---|---|---|
| 6,373,454 | B1 * | 4/2002 | Knapp et al. | 345/76 |
| 6,661,180 | B2 | 12/2003 | Koyama | 315/169.3 |
| 7,242,397 | B2 | 7/2007 | Iseki et al. | 345/204 |
| 2002/0135312 | A1 * | 9/2002 | Koyama | 315/169.3 |
| 2004/0183752 | A1 | 9/2004 | Kawasaki et al. | 345/20 |
| 2005/0122150 | A1 | 6/2005 | Iseki et al. | 327/215 |
| 2005/0285151 | A1 | 12/2005 | Kawasaki | 257/213 |
| 2006/0012310 | A1 * | 1/2006 | Chen et al. | 315/169.3 |
| 2006/0066535 | A1 * | 3/2006 | Shirasaki et al. | 345/76 |
| 2006/0114194 | A1 | 6/2006 | Kawasaki et al. | 345/76 |
| 2006/0114195 | A1 | 6/2006 | Yamashita et al. | 345/76 |
| 2006/0132395 | A1 | 6/2006 | Kawasaki et al. | 345/75.2 |
| 2006/0176250 | A1 * | 8/2006 | Nathan et al. | 345/76 |
| 2007/0132719 | A1 | 6/2007 | Yamashita et al. | 345/156 |
| 2008/0157828 | A1 | 7/2008 | Kawasaki et al. | 327/108 |
| 2008/0158112 | A1 | 7/2008 | Kawasaki et al. | 345/76 |

* cited by examiner

*Primary Examiner* — Chanh Nguyen
*Assistant Examiner* — Long D Pham
(74) *Attorney, Agent, or Firm* — Fitzpatrick, Cella, Harper & Scinto

(57) ABSTRACT

An active matrix display apparatus includes two-dimensionally arranged pixel circuits, each of which includes a display element, and a plurality of signal lines and scanning lines connected to the pixel circuits. Each of the pixel circuits include a drive transistor and a capacitor, with one terminal of the capacitor being connected to a control terminal of the drive transistor and a second terminal of the capacitor being connected to a first main conductive terminal of the drive transistor and a lighting power source. In a writing operation period, a current flowing to the signal line is conducted into the drive transistor, and in a lighting operation period, a current conducting in the drive transistor is injected into the display element. At a time during the writing operation period, a potential of the lighting power source is changed toward a potential of the signal line to depress the current conducting in the drive transistor and is kept for a period, during which the current conducting in the drive transistor partially recovers from the depression. After the writing operation period, the potential of the lighting power source is restored.

6 Claims, 7 Drawing Sheets

ACTIVE MATRIX DISPLAY APPARATUS HAVING A CHANGE IN LIGHTING POWER SOURCE BEFORE THE END OF A WRITING PERIOD AND DRIVING METHOD THEREOF

BACKGROUND OF THE INVENTION

1. Field of the Invention

The present invention relates to an active matrix display apparatus using an electro-luminescence element (hereinafter, referred to as EL element) which emits light by injecting a current for an image display, and a driving method of the same. Hereinafter, in the present specification, the active matrix display apparatus using the EL element is referred to as an EL panel.

2. Description of the Related Art

Active Matrix Display Apparatus

FIG. 4 illustrates an overall configuration example of a color EL panel. The color EL panel shown in the figure includes a column control circuit 3, a column register 5, a row register 6, and a control circuit 9 in addition to a display region 2 in which a pixel circuit 1 including a display element (EL element) and its drive circuit is two-dimensionally arranged.

In the display region 2, a plurality of pixel circuits 1 is arranged in a matrix pattern along a row direction and a column direction. The pixel circuit 1 performs acquiring and storing of a display signal and driving of the EL element. When a pixel circuit has such a function, this display apparatus is referred to as an active matrix display apparatus.

Each pixel circuit 1 is connected with a signal line 4 and a scanning line 7 of the column corresponding to the pixel circuit. Each of the pixel circuits 1 of the row corresponding thereto acquires the display signal supplied to the corresponding signal line 4 all at once in accordance with a control signal (scanning signal) of the scanning line 7(row selection period). When the next scanning signal is activated, the display element contained in each pixel circuit 1 is lighted with luminance corresponding to the acquired display signal (lighting period). The pixel circuits 1 are divided into three sets having the display elements corresponding respectively to one of three primary colors RGB to attain a color display.

The scanning signal of each scanning line 7 is generated by a row register 6 having register blocks provided to the respective rows, to each of which register blocks a row clock KR and a row scan start signal SPR are input. The display signals of the respective columns, which are supplied to each signal line 4, are generated by the column control circuits 3 provided to the respective columns. The column control circuits 3 are divided into three sets corresponding respectively to the display elements of the three primary colors RGB, each arranged every three columns. The column control circuit 3 of each column supplies a desired display signal to the signal line 4 of each column in accordance with a video signal VIDEO and a sampling signal SP as well as a horizontal control signal 8. A control circuit 9 is input with a horizontal sync signal SC corresponding to the video signal VIDEO 9, and generates a horizontal control signal 8. The sampling signal SP is generated by a column register 5 including the registers of one third of the number of the column control circuit 3. The column register 5 is input with a column clock KC and a column scanning start signal SPC as well as a horizontal control signal 8 which is used mainly for a reset operation of the column register 5.

Pixel Circuit

The pixel circuit 1 of a current writing type is commonly adopted, such a type being hard to be affected by a variation of characteristics of a TFT (thin film transistor) to be used therein. In this case, the display signal supplied to the signal line 4 is a current signal. The pixel circuit 1 of the display panel commonly includes the TFT. Since the TFT has a large variation in characteristics, the current writing type which is hard to be affected by the variation of characteristics is often used.

FIGS. 5 and 6 are configuration examples of the pixel circuit of a current writing type (referred to also as "current programming method") disclosed in U.S. Pat. Nos. 6,373,454 and 6,661,180. The pixel circuit 1 shown in the Figures has an EL element (EL in the Figures) which is the display element and a drive circuit of the EL element. The drive circuit, in the examples of the Figures, includes switching transistors (hereinafter, referred to as transistor) M1, M2, and M4 each made of an n-type TFT, a drive transistor M3 made of a p-type TFT, and a capacitor (capacitor or storage capacitor) C1.

The pixel circuit 1 is connected with an emission power source line PVdd, a signal line data for supplying a current Idata, and two scanning lines P1 and P2 for supplying the scanning signals, and performs a current writing operation and a lighting operation through the drive circuit of the EL element. The EL element has an anode terminal (current injection terminal) connected to the emission power source line PVdd (first power source) through a transistor M4 and a drive transistor M3 and a cathode terminal connected to a ground line (second power source) CGND.

FIG. 7 illustrates a time chart of each scanning signal of the scanning lines P1 and P2.

First, at the time of the current writing operation (Row selection period T1), each scanning signal of the scanning lines P1 and P2 becomes P1=H level, P2=L level, respectively, and the transistors M1 and M2 are turned on, and the transistor M4 is turned off. Then, a drain terminal of the drive transistor M3 is isolated from the current injection terminal (anode terminal in the examples of FIGS. 5 and 6) of the EL element through the transistor M4. In this state, the drive transistor M3 is connected to the signal line data through a gate terminal thereof, and the gate terminal and the drain terminal of the drive transistor M3 are short-circuited, thereby the transistor being put into a diode-connection state. As a result, a gate voltage decided by the characteristic of the drive transistor M3 is generated due to the current Idata supplied to the signal line data so as to charge the storage capacitor C1 between the gate terminal and the source terminal.

Next, at the time of the lighting operation (lighting period T2), each scanning signal of the scanning lines P1 and P2 becomes P1=L level and P2=H level, respectively, and the transistors M1 and M2 are turned off, and the transistor M4 is turned on. Then, the drive transistor M3 is connected to the current injection terminal (anode terminal in the examples of FIGS. 5 and 6) of the EL element through the drain terminal thereof. In this state, the gate terminal of the drive transistor M3 is isolated from the signal line data so that the transistor M3 is put into a released state, and therefore, at the time of the current writing operation time, the voltage charged into the storage capacitor C1 between the gate terminal and the source terminal reaches a gate voltage of the transistor M3 as it is. As a result, the current flowing into the drive transistor M3 becomes substantially the current Idata of the signal line data, and therefore, the EL element can light with light emission luminance corresponding to the current Idata.

When the pixel circuit 1 shown in FIG. 5 is actually formed on the substrate as a display panel, each pixel circuit 1, as shown in FIG. 8, is accompanied with parasite capacitances cx1 and cx4 caused by wiring cross of the scanning lines P1 and P2 and the signal line data. In a high definition display panel, a top emission method is common, in which light is taken out from a surface of the pixel circuit 1. Hence, the signal line data overlaps with a cathode transparent electrode layer formed on the whole surface of a display region, in the region overlapping with the anode electrode of the EL element and the region not overlapping with the anode electrode, and therefore, each of the parasite capacitances cx2 and cx3 is accompanied. In addition to this, the signal line data is accompanied with a capacitance cx5 between a control terminal (gate terminal) of the transistor M2 and a main conductive terminal (source or drain terminal).

The parasitic capacitance accompanied with the signal line data of each column is a sum total of the parasitic capacitances accompanied with the pixel circuit of each column. The parasitic capacitance value accompanied with this signal line depends on a panel size and the number of displays. For example, in the display panel of three inches-480 columns, the capacitance value becomes approximately 5 pF. Even in the pixel circuit of FIG. 6, the parasitic capacitance value accompanied with this signal data becomes also approximately 5 pF.

However, the current writing operation of the pixel circuit shown in FIGS. 5 and 6 is significantly affected by the parasitic capacitance value. The signal current completes the programming within the writing period through charging or discharging the parasitic capacitance of the signal line in addition to the storage capacitance of the pixel. Consequently, a current writing operation ability (PRG ability) is shown conceptually by the following formula (1).

$$\text{“}PRG\text{ ability”}=\text{“write current”}\times\text{“write time”}\div\text{“signal line parasitic capacitance”} \quad (1)$$

When the “PRG ability” value is not secured, the current writing operation becomes insufficient, and the display image quality is remarkably damaged.

As shown in the formula (1), when the write current in low luminance is small, the PRG ability becomes small. The signal line parasitic capacitance is almost decided by the number of display rows and the display size, but the drastic reduction beyond the same is difficult. The write time is also restricted by the time decided from the number of displayed rows and a refresh rate.

The drive current injected into the EL element is decided by the brightness of the EL element, and therefore, the drive current cannot be set large without any restriction. Hence, the writing current cannot be set large also. When the light emission duty is set small and an instant brightness of the EL element is set large, the write current can be also set large. However, when the current is set large, this causes a problem that deterioration of the brightness of the EL element is accelerated.

SUMMARY OF THE INVENTION

It is an aspect of the invention to solve such problem and improve current writing operation ability (PRG ability) in a low drive current (low luminance) region by simple means.

According to an aspect of the invention, there is provided an active matrix display apparatus comprising: two-dimensionally arranged pixel circuits each of which includes a display element; and a plurality of signal lines and a plurality of scanning lines connected to said pixel circuits, each of said pixel circuits including a drive transistor and a capacitor, a terminal of the capacitor is connected to a control terminal of the drive transistor and the other terminal of the capacitor is connected to a first main conductive terminal of said drive transistor and a lighting power source, wherein at the time of a writing operation, a current flowing in the signal line is conducted into said drive transistor and at the time of a lighting operation, a current conducting in said drive transistor is injected into said display element, and before completion of the writing operation, a potential of the lighting power source is changed toward the potential of the signal line and is kept for a period, and after the completion of the writing operation, the potential of the lighting power source is recovered.

In the present invention, the pixel circuit further includes a first switch, a second switch, and a third switch, each including a transistor an on-off operation of which is controlled in accordance with a control signal of the scanning line. The first switch is arranged between the control terminal of the drive transistor and the other terminal of the capacitor and the signal line. The second switch is arranged between a second main conductive terminal of the drive transistor and the signal line. The third switch is arranged between the second main conductive terminal of the drive transistor and one of terminals of the display element.

The scanning line includes a first scanning line and a second scanning line. The first scanning line is connected to the control terminal of each of the first switch and the second switch, and the second scanning line is connected to the control terminal of the third switch.

Each of the drive transistor, the first switch, the second switch, and the third switch may include the TFT. The drive transistor may include a p-type TFT, and each of the first switch, the second switch, and the third switch may include an n-type TFT.

According to another aspect of the invention, a driving method of the active matrix type display apparatus including two-dimensionally arranged pixel circuits; and a plurality of signal lines and a plurality of scanning lines connected to the pixel circuits, each of the pixel circuit including a drive transistor and a capacitor a terminal of the capacitor is connected to a control terminal of said drive transistor, and the other terminal of said capacitor is connected to a first main conductive terminal of said drive transistor and a lighting power source, said driving method comprising the steps of: conducting the current flowing in said signal line into said drive transistor at the time of the writing operation; changing a potential of the lighting power source toward a potential of the signal line and keeping the changed potential for a period; injecting a current conducting said drive transistor into said display element at the time of the lighting operation, and recovering the potential of the lighting power source.

According to the present invention, the current writing operation ability (PRG ability) can be improved in a low drive current (low luminance) region with simple means.

The present invention can be applied to an EL panel, and a pixel circuit and driving method thereof, used for the EL panel.

By using the display apparatus of the present invention, electronic equipment such as a television and portable equipment can be constituted.

Further features of the present invention will become apparent from the following description of exemplary embodiments with reference to the attached drawings.

DESCRIPTION OF THE EMBODIMENTS

Exemplary embodiments of the present invention will be described below with reference to the drawings.

Figure 1:
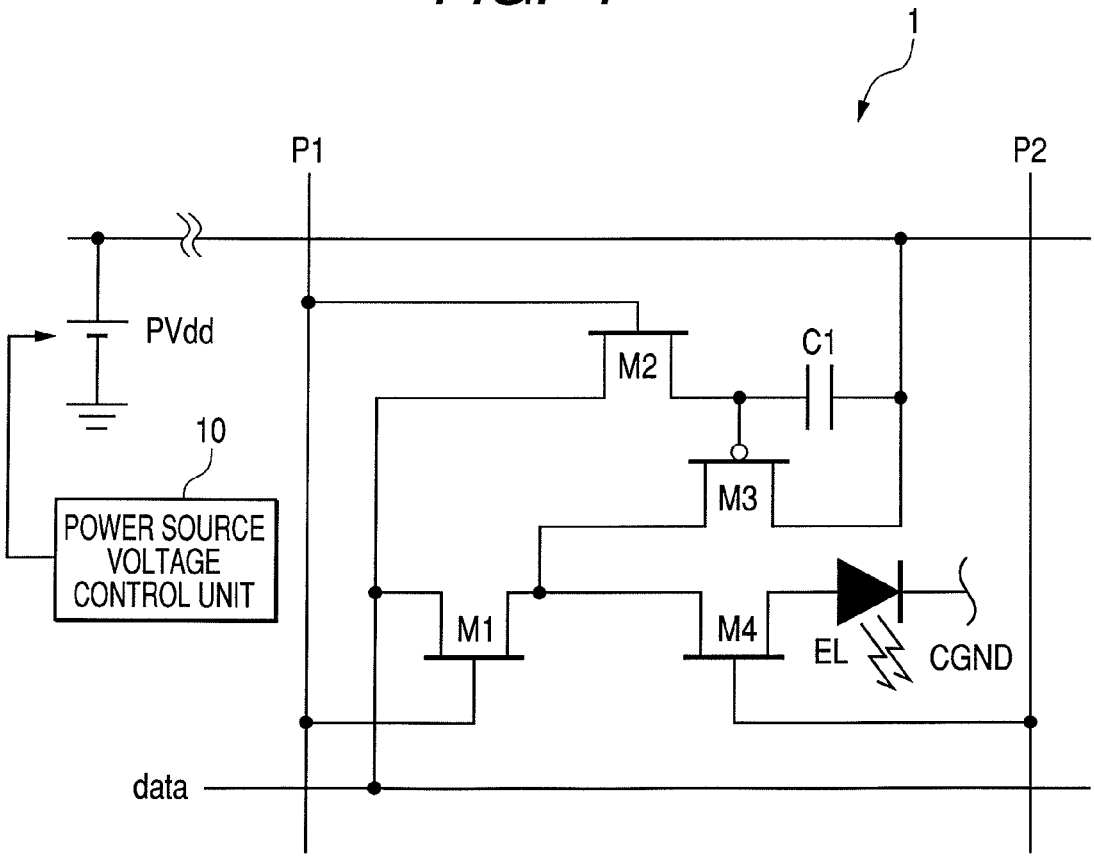
FIG. 1 is a circuit diagram showing a configuration of a pixel circuit of an EL panel according to an embodiment of the present invention.

An EL panel (active matrix type display apparatus) according to the present embodiment uses a current writing type pixel circuit 1 shown in FIG. 1.

The pixel circuit 1 shown in FIG. 1 includes an EL element being a display element (referred to also as "OLED: Organic Light Emitting Diode") and a drive circuit of the EL element. The drive circuit includes switch transistors (hereinafter, referred to as transistor) M1, M2, and M4 each including an n-type TFT, a transistor M3 including a p-type TFT, and a capacitor (capacitor or storage capacitor) C1. The pixel circuit 1 is connected with a light emission power source line PVdd, a ground line CGND, a signal line (data) for supplying a current Idata, two scanning lines P1 and P2 for supplying scanning signals to control an on-off operation of transistors M1, M2, and M4.

The EL element has an anode terminal (current injection terminal) connected to a light emission power source line (hereinafter, referred to as lighting power source) PVdd through the transistor M4 and the drive transistor M3, and has a cathode terminal connected to a ground line CGND.

A gate terminal (control terminal) of the drive transistor M3 is connected to the signal line data through the transistor M1, while also being connected to one of terminals of the capacitor C1. A source terminal (first main conductive terminal) of the drive transistor M3 is connected to a light emission power source line PVdd and the other terminal of the capacitor C1. A drain terminal (second main conductive terminal) of the drive transistor M3 is connected to the signal line (data) through the transistor M2, while also being connected to an anode terminal of the EL element through the transistor M4.

One of the source and drain terminals of the transistor M2 (first switch) is connected to the gate terminal of the drive transistor M3 and one terminal of the capacitor C1. The other of the source and drain terminals of the transistor M2 is connected to the signal line (data). The gate terminal of the transistor M1 is connected to the scanning line P1 (first scanning line, and an on-off operation of the transistor M1 is controlled by the scanning signal (L and H levels).

One of the source and drain terminals of the transistor M1 (second switch) is connected to the signal line (data) and the other of the source and drain terminals of the drive transistor M3. The other of the source and drain terminals of the transistor M1 is connected to the drain terminal of the transistor M3 and one of the source and drain terminals of the transistor M4. The gate terminal of the transistor M2 is connected to the scanning line P1 (first scanning line), and an on-off operation of the transistor M2 is controlled by the scanning signal (L and H levels).

One of the source and drain terminals of the transistor M4 (third switch) is connected to the drain terminal of the drive transistor M3 and the other of the source and drain terminals of the transistor M1. The other of the source and drain terminals of the transistor M4 is connected to the anode terminal of the EL element. The gate terminal of the transistor M4 is connected to the scanning line P2 (second scanning line) and an on-off operation of the transistor M4 is controlled by the scanning signal (L and H levels).

In the present embodiment, the voltage control of a lighting power source Vdd is executed by a peripheral circuit outside the display region of the EL panel or a power source voltage control unit 10 arranged at the outside of the EL panel.

Figure 2:
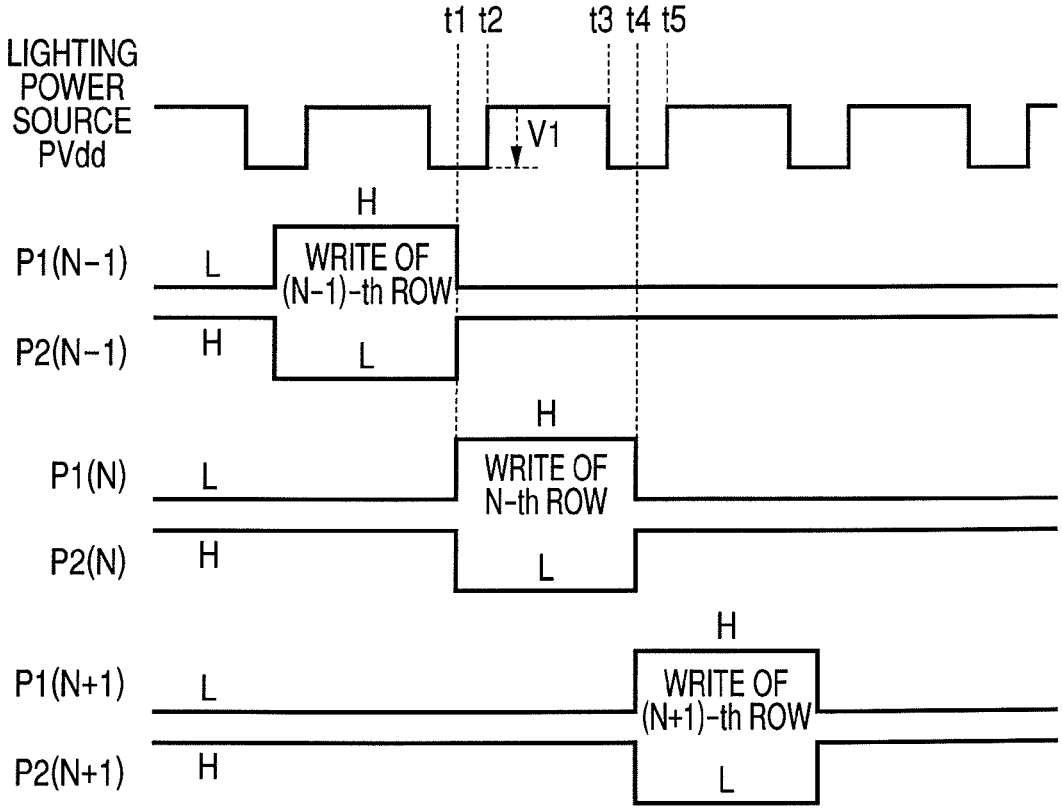
FIG. 2 is a time chart for describing the drive operation of the EL panel according to the embodiment of the present invention.
Figure 7:
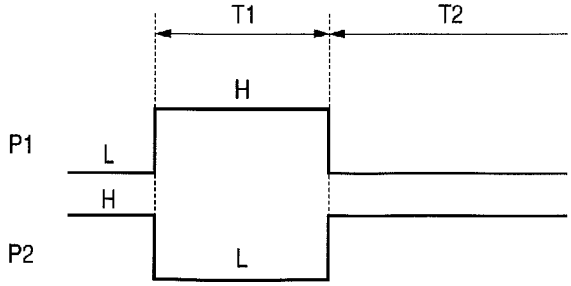
(Prior Art) FIG. 7
FIG. 7 is a time chart for describing the operation of the conventional pixel circuit.
Figure 8:
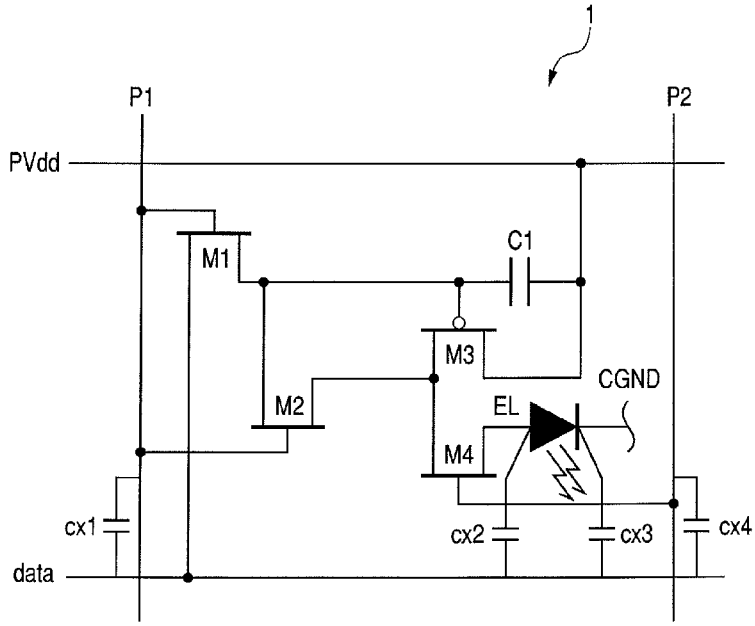
(Prior Art) FIG. 8
FIG. 8 is a circuit diagram written with a parasite capacitance accompanied with a signal line of the conventional pixel circuit.

FIG. 2 is a time chart showing the operation of the pixel circuit 1 of the present embodiment. In the Figure, operation timings of the lighting power source PVdd and each of the scanning signals P1 and P2 of (N−1) row, (N) row, (N+1) row are shown. The operation timing of the scanning signals P1 and P2 are the same as the case described in FIG. 7, and hence, the detail thereof will be omitted.

As shown in FIG. 2, in the present embodiment, before completion of the current writing period T1 (P1=L level) of the relevant row, the lighting power source PVdd is lowered by a voltage V1, and after starting the lighting period T2 of the relevant row (P2=H level), the lighting power source PVdd is restored to the original voltage. Consequently, the lighting power source PVdd is lowered by the voltage V1 in a write transition period to the next row, provided for every row period. The operation control of the lighting power source PVdd during this period is executed by the power source voltage control unit 10 in the present embodiment.

Next, referring to FIGS. 2 and 3, the operation of the pixel circuit 1 of the present embodiment will be described.

Figure 3:
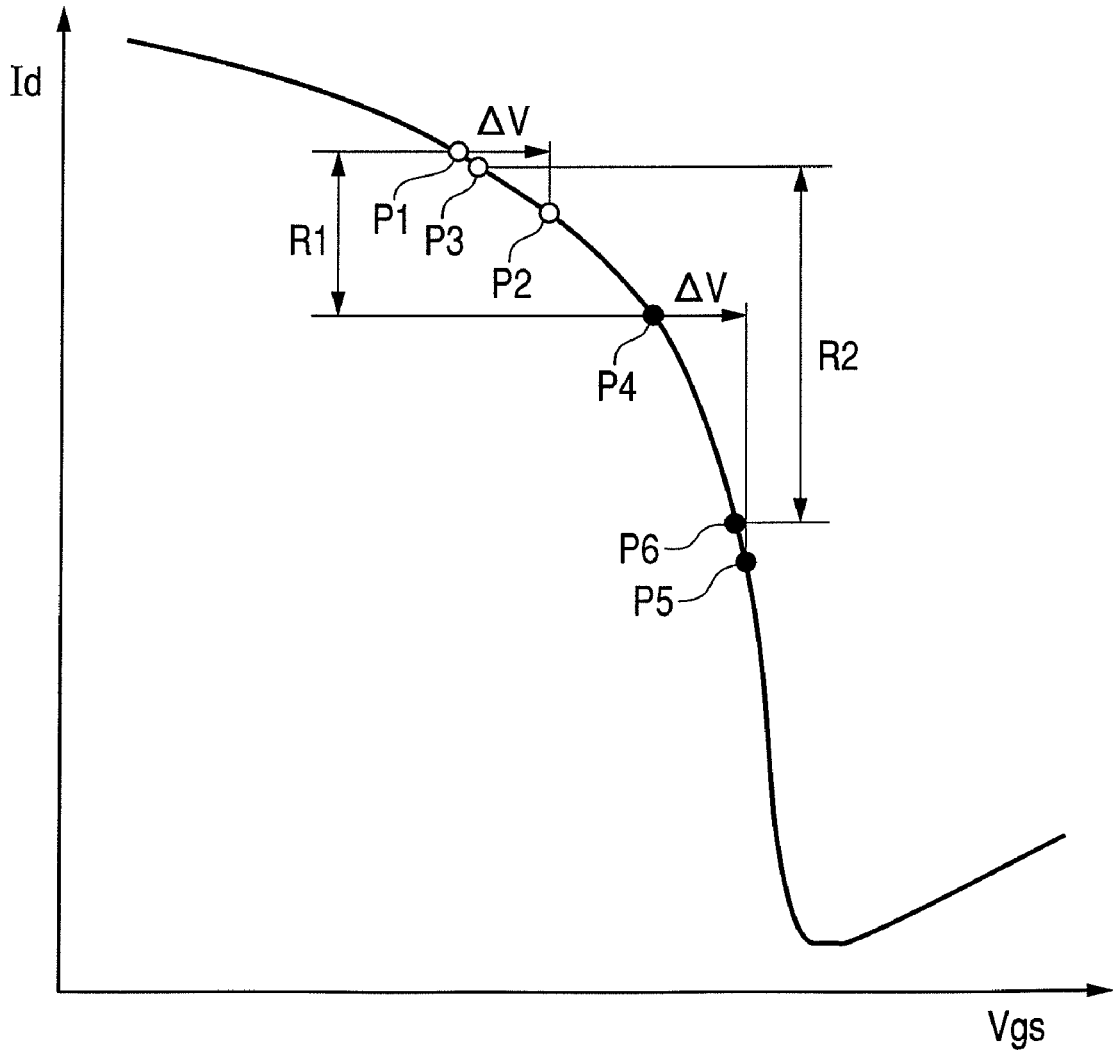
FIG. 3 is a Vgs-Id characteristic chart for explaining the operation of a drive transistor in the pixel circuit of the EL panel according to the embodiment of the present invention.
Figure 4:
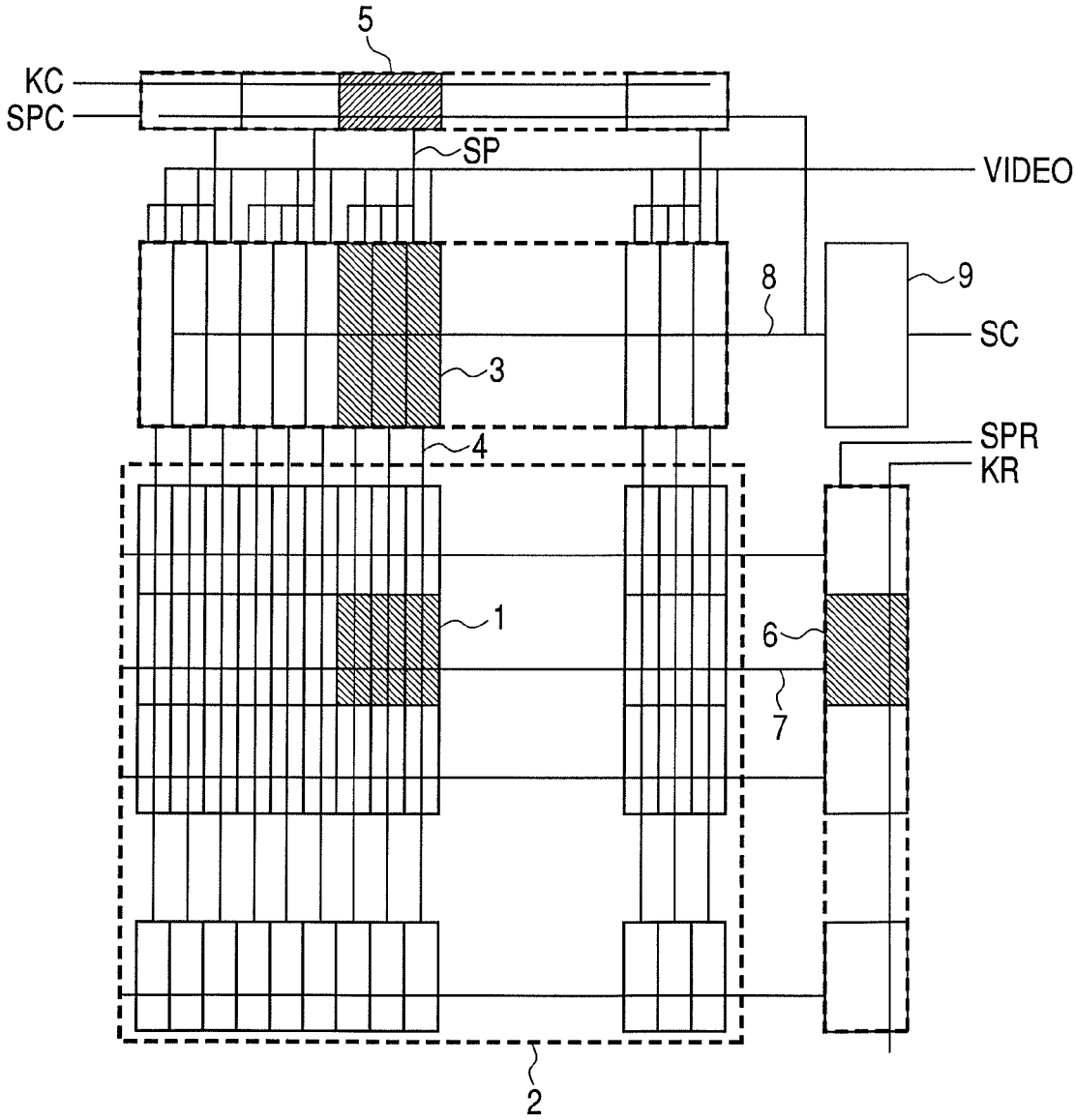
FIG. 4 is a whole conceptual view of a color EL panel.
Figure 5:
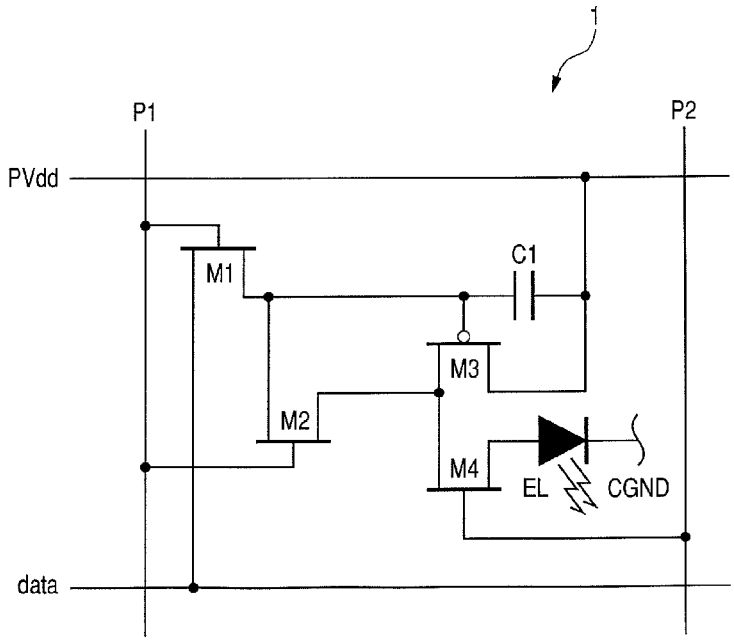
(Prior Art) FIG. 5
FIG. 5 is a circuit diagram showing the configuration of a conventional pixel circuit.
Figure 6:
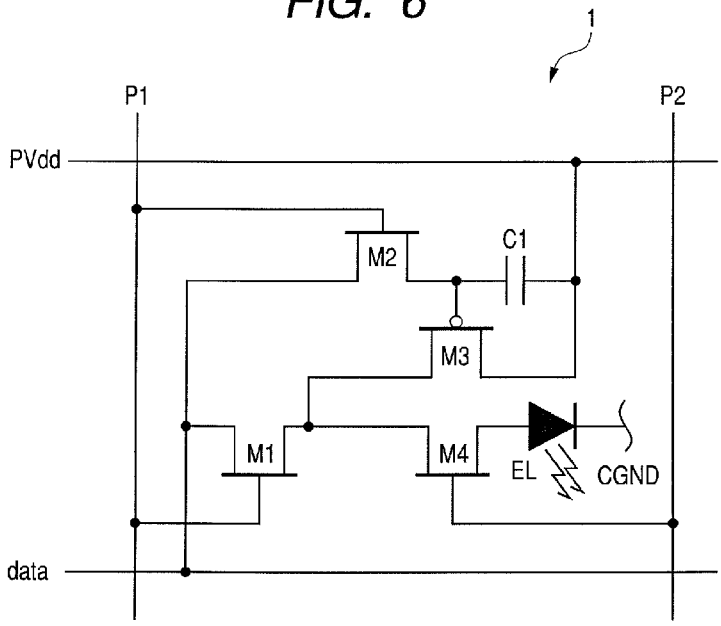
(Prior Art) FIG. 6
FIG. 6 is a circuit diagram showing the configuration of another conventional pixel circuit.

FIG. 3 illustrates a Vgs (gate and source voltage)-Id (drain current) characteristic curve of the drive transistor M3 of the pixel circuit 1 of FIG. 1. The drain current Id is shown by a logarithmic axis. The characteristic curve shown in FIG. 3 represents general properties of a MOS (Metal Oxide Semiconductor) transistor including the TFT. Since the operation of the pixel circuit 1 is not restricted depending on a row number, in the following description, the pixel circuit 1 of (N)th row will be described in detail. Here, the description will be made by driving it for the operation time of a high drive current (high luminance) region and for the operation time of a low drive current (low luminance) region.

Operation Time at High Drive Current Region

First, the operation time of the high drive current region will be described.

First, at a time t1, the writing operation (period T1) of (N)th row is started, and a signal current of a large current starts being supplied to the signal line data. At this time, the lighting power source PVdd is lowered by a voltage V1.

Next, at a time t2, the lighting power source PVdd is restored to the original voltage, and a normal writing operation is started. Immediately before a time t3, the conductive current supplied to the drive transistor M3 of the pixel circuit 1 has a large signal current and can complete the current writing operation, and therefore, will have the same value as the signal current. At the operation time of the high drive current region, the drive transistor M3 operates at a point shown by "P1" on the Vgs-Id characteristic curve of FIG. 3.

Next, at a time of t3, the lighting power source PVdd has the voltage lowered by a predetermined value V1. At this time, the Vgs voltage of the drive transistor M3 is also lowered.

The voltage drop ΔV can be roughly shown by the following formula (2).

$$\Delta V = Cs/(Cs+Cg) \times V2 \quad (2)$$

Cs: a parasitic capacitance accompanied with the signal line data of each column Cg: a sum of the gate capacitances of the storage capacitor C1 and the drive transistor M3

In a compact or a high definition display panel, since the pixel circuit 1 is unable to occupy a large area, the sizes of the storage capacitor C1 and the drive transistor M3 cannot be increased. Hence, the storage capacitance Cg of the drive transistor M3 is considerably small as compared with the parasitic capacitance Cs of the signal line data. For example, the signal line parasitic capacitance cs=5 pF, whereas the storage capacitance Cg=0.5 pF. The voltage drop ΔV of the drive transistor M3 is approximately 90% of the voltage drop V1 of the lighting power source PVdd. At this time, the drive transistor M3 moves to an operation point denoted by "P2" on the Vgs-Id characteristic curve of FIG. 3 by the voltage drop ΔV, and the conductive current is lowered as illustrated.

Next, in the period up to a time t4, a recovery operation of the current writing by a large signal current is completed. Immediately before the time t4, though the recovery operation of the current writing cannot be concluded, as shown by the point of "P3" on the Vgs-Id characteristic curve of FIG. 3, the time t4 is met at an asymptotic point of desired signal current, and the current writing operation (period T1) is concluded. Subsequent to the time t4, the operation moves to the lighting operation (period 2), and the current writing operation similarly moves to the (N+1) row, which is the next row.

Next, at a time t5, though the lighting power source PVdd returns to the original voltage again, the pixel circuit 1 of the (N)th row is not connected with the signal line data, and a current path in the gate terminal of the drive transistor M3 is blocked, and therefore, the Vgs voltage is unable to change. Hence, the operation of the drive transistor M3 shown by a point of "P3" on the Vgs-Id characteristic curve of FIG. 3 does not substantially change. This operation is the same for all the pixel circuits 1 except for the pixel circuit 1 of the (N+1)th row on which the current writing operation is not performed. That is, the pixel circuit 1 during the lighting period has the lighting operation not substantially affected by the voltage drop TV1 of the lighting power source PVdd.

Operation Time at Low Drive Current Region

Next, the operation time at the low drive current region will be described.

First, at the time t1, the writing operation of the (N)th row (period T1) starts, and the desired signal current starts being supplied to the signal line. At this time, the lighting power source PVdd has the voltage lowered by the predetermined value V1.

Next, at the time t2, the lighting power source PVdd is restored to the original voltage, and starts the normal writing operation. Immediately before the time t3, the conductive current supplied to the drive transistor M3 of the pixel circuit 1 has a large signal current to some extent, and therefore, will have the same value as the signal current. At the operation time at the low drive current region, the drive transistor M3 operates at a point denoted by "P4" on the Vgs-Id characteristic curve of FIG. 3.

Next, at the time t3, the lighting power source PVdd has the voltage lowered by the predetermined value V1. At this time, the voltage Vgs of the drive transistor M3 is also lowered by the voltage drop ΔV as shown in the formula (2). At this time, the drive transistor M3 moves to the operation point denoted by "P5" on the Vgs-Id characteristic curve of FIG. 3 by the voltage drop ΔV, and as illustrated, the conductive current moves to a subthreshold area having an exponential characteristic, and this lowers the current incommensurably to a large extent.

Next, in the period up to the time t4, since the signal current is relatively small, the recovery operation of the current writing by the signal current is started. However, sufficient operation cannot be realized. Since the recovery operation of the current writing hardly progresses up to time immediately before the time t4, the time 4 reaches with no large movement made from an operation point denoted by "P5" as shown by a point of "P6" on the Vgs-Id characteristic curve of FIG. 3, and therefore the current writing operation (period T1) is completed. Subsequent to the time t4, the operation moves to the lighting operation (period T1), and the current writing operation similarly moves to the (N+1) row, which is the next row.

Next, at a time t5, though the lighting power source PVdd is restored to the original voltage again, the pixel circuit 1 of the (N)th row is not connected to the signal line data, and the current path in the gate terminal of the drive transistor M3 is blocked, and therefore, the voltage Vgs can not change. Hence, the operation of the drive transistor M3 shown by a point of "P6" on the Vgs-Id characteristic curve of FIG. 3 does not change substantially. This operation is the same also for all the pixel circuits 1 except for the pixel circuit 1 of the (N+1)th on which the current writing operation is not performed. That is, the pixel circuit 1 during the lighting period is not substantially affected by the voltage drop V1 of the lighting power source PVdd.

In the operations as described above, the very small drive current necessary for the low luminance display shown by "P6" on the Vgs-Id characteristic curve of FIG. 3 can be realized by an incommensurably large writing current shown by "P4" on the same curve of the same Figure. The drive current necessary for the high luminance display shown by "P3" on the Vgs-Id characteristic curve of FIG. 3 can be realized by an approximately equal writing current shown in "P1" on the same curve of the same Figure. That is, since the drive current of the incommensurably large dynamic range (see R2 between P3 and P6 of FIG. 3) can be generated by the writing current of the small dynamic range (see R1 between P1 and P1 of FIG. 3), a contrast ratio which is an important element of the display image quality can be easily secured.

Moreover, the operating setting is desirably adjustable in accordance with the amount of the voltage drop of the lighting power source PVdd, the timing t3, and the voltage drop period (t4 to t3). The recovering timing 5 after the voltage drop of the lighting power source PVdd is not also restricted to being after completion of the writing current (lighting period) of the pixel circuit 1, and the intended operation can be substantially attained even within the write current period.

Since the above described operation uses the continuous Vgs-Id characteristic of the MOS transistor shown in FIG. 3, a seamless operation from the high drive current (high luminance) to the low drive current (low luminance) can be realized. This is very important in order to obtain a display image having no sense of strangeness.

As described above, in the present embodiment, during the current writing period T1, the source terminal and the drain terminal of the drive transistor M3 are connected between the lighting power source PVdd and the signal line data, and a signal current is let flow between both terminals. By doing so, the capacitor C1 between the gate terminal and the source terminal of the drive transistor M3 is charged. After that, before the completion of the current writing period T1, potential of the lighting power source PVdd is changed toward the potential of the signal line data, and thereby continuing the changed potential for a desired fixed period. When the writing period is terminated and the lighting period T2 is started, the connection between the drive transistor M3 and the signal line date is cut off, and the potential of the lighting power source PVdd is restored to the original potential. By doing so, the voltage of the capacitor C1 is made smaller than the voltage at the charging time, so that the current corresponding to the voltage is supplied to the EL element to emit light.

That is, in the present embodiment, in the pixel circuit 1, the potential of the lighting power source PVdd is changed toward the potential of the signal line to start a voltage drop by the predetermined value V1 before the completion of the current writing period T1, and continue the voltage drop for a fixed period. As a result, the following effects can be attained.

1) By a practicable control of the lighting drive power source from the outside of the display panel, the current writing operation ability can be improved. As a result, the present invention can be easily realized even if a display panel with the conventional configuration is adopted as it is.

2) In each pixel circuit with a simple configuration, the writing current for the desired drive current can be made large as compared with the conventional write current. As a result, the current writing operation ability can be improved, and consequently, the display image quality is improved.

3) A reduction rate of the drive current for the writing current can be increased in proportion as the writing current becomes small. Hence, the current writing operation, which specifically raises a problem in the low drive current (low luminance) region, can be improved incommensurably to a large extent.

4) A reduction rate of the drive current for the writing current can be made small when the write current is large. Hence, the writing current in the high drive current (high luminance) region, which is particularly difficult to be attained by the TFT circuit, may not be required to be largely different from the conventional configuration.

Consequently, according to the present embodiment, the micro drive current necessary for the low luminance display can be realized by an incommensurably large writing current, and the current writing operation ability in the low drive current (low luminance) region can be improved to a large extent by simple means.

In each of the above described embodiments, while the drive transistor includes the p-type TFT, and the switching transistors M1, M2, and M4 each include the n-type TFT, the present invention is not limited to this. The TFT to be used may be applied with any of the n-type and the p-type. An active layer of the TFT may be composed by using amorphous silicon or may include a material made of silicon as a base material or a material made of metal oxide as a base material or a material including an organic matter as a base material.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2007-202991, filed Aug. 3, 2007, which is hereby incorporated by reference herein in its entirety.

What is claimed is:

1. An active matrix display apparatus comprising:

two-dimensionally arranged pixel circuits, each of which includes a display element; and a plurality of signal lines and a plurality of scanning lines connected to the pixel circuits, each of the pixel circuits including a drive transistor and a capacitor, with one terminal of the capacitor being connected to a control terminal of the drive transistor, and a second terminal of the capacitor being connected to a first main conductive terminal of the drive transistor and a lighting power source, wherein in a writing operation period, a current flowing to the signal line is conducted into the drive transistor, and in a lighting operation period, a current conducting in the drive transistor is injected into the display element, at a time when the current flowing to the signal line is conducted into the drive transistor in the writing operation period, a potential of the lighting power source is lowered to depress the current conducting in the drive transistor and is kept for a period until the potential of the lighting power source is restored after the writing operation period is terminated, and during a period in which the potential of the lighting power source is lowered, the current conducting in the drive transistor partially recovers from the depression in accordance with the amount of the current flowing in the signal line, and wherein in a writing transition period, the lighting power source is lowered in voltage before the end of the writing operation period of a first row of pixels and is raised to a higher voltage after the start of the writing operation period of a next row of pixels.

2. The active matrix display apparatus according to claim 1, wherein the pixel circuit further comprises a first switch, a second switch, and a third switch, each including a transistor, an on-off operation of which is controlled in accordance with a control signal of the scanning line, and wherein the first switch is arranged between the control terminal of the drive transistor and the second terminal of the capacitor and the signal line, the second switch is arranged between a second main conductive terminal of the drive transistor and the signal line, and the third switch is arranged between the second main conductive terminal of the drive transistor and the other terminal of the display element.

3. The active matrix display apparatus according to claim 2, wherein the scanning line includes a first scanning line and a second scanning line, the first scanning line being connected to the control terminal of each of the first switch and the second switch, and the second scanning line being connected to a control terminal of the third switch.

4. The active matrix display apparatus according to claim 2, wherein each of the drive transistor, the first switch, the second switch, and the third switch includes a TFT.

5. The active matrix display apparatus according to claim 2, wherein the drive transistor includes a p-type TFT, and wherein each of the first switch, the second switch, and the third switch includes a n-type TFT.

6. A driving method of an active matrix type display apparatus including two-dimensionally arrangement pixel circuits, each of which includes a display element, a plurality of signal lines, and a plurality of scanning lines connected to the pixel circuits, each of the pixel circuits including a drive transistor and a capacitor, with a first terminal of the capacitor being connected to a control terminal of the drive transistor, and a second terminal of the capacitor being connected to a first main conductive terminal of the drive transistor and a lighting power source, the driving method comprising the steps of:

in a writing operation period, conducting the current flowing in the signal line into the drive transistor by connecting a second main conductive terminal and the control terminal of the drive transistor with the signal line;

at a time when the current flowing to the signal line is conducted into the drive transistor, lowering a potential of the lighting power source to depress the current conducting in the drive transistor;

during a period in which the potential of the lighting power source is lowered, partially recovering the current conducting in the drive transistor from the depression in accordance with the amount of the current flowing in the signal line in a lighting operation period;

in the lighting operation period, injecting the current conducting the drive transistor into the display element by disconnecting the second main conductive terminal and the control terminal of the drive transistor from the signal line and connecting the second main conductive terminal with the display element, restoring the potential of the lighting power source, and in a writing transition period, lowering the lighting power source in voltage before the end of the writing operation period of a first row of pixels and raising the lighting power source to a higher voltage after the start of the writing operation period of a next row of pixels.

* * * * *